US011346277B1

(12) United States Patent
Marrero

(10) Patent No.: US 11,346,277 B1
(45) Date of Patent: May 31, 2022

(54) TWO-CYCLE MOTOR

(71) Applicant: Jose Marrero, Miami, FL (US)

(72) Inventor: Jose Marrero, Miami, FL (US)

( * ) Notice: Subject to any disclaimer, the term of this patent is extended or adjusted under 35 U.S.C. 154(b) by 0 days.

(21) Appl. No.: 17/544,434

(22) Filed: Dec. 7, 2021

(51) Int. Cl.

| | |
|---|---|
| ***F02B 33/14*** | (2006.01) |
| ***F02B 75/02*** | (2006.01) |
| ***F02B 33/44*** | (2006.01) |
| ***F02B 33/30*** | (2006.01) |
| ***F02B 21/00*** | (2006.01) |
| ***F02B 75/28*** | (2006.01) |

(52) U.S. Cl.
CPC ..... *F02B 33/14* (2013.01); *F02B 21/00* (2013.01); *F02B 33/30* (2013.01); *F02B 33/44* (2013.01); *F02B 75/02* (2013.01); *F02B 75/28* (2013.01); *F02B 2075/025* (2013.01)

(58) Field of Classification Search
CPC ..... F02B 33/14; F02B 21/00; F02B 33/30; F02B 33/44; F02B 75/02; F02B 2075/025; F02B 75/28; F01L 1/047; F01L 9/04; F02D 41/26
See application file for complete search history.

(56) References Cited

U.S. PATENT DOCUMENTS

| | | | | |
|---|---|---|---|---|
| 2,455,245 | A | 11/1948 | Francis | |
| 2,916,025 | A | 12/1959 | Klotsch | |
| 2004/0216705 | A1* | 11/2004 | Le Bleis | F02B 33/26 123/65 S |
| 2017/0016387 | A1* | 1/2017 | Cannata | F02B 33/14 |

* cited by examiner

*Primary Examiner* — Syed O Hasan
(74) *Attorney, Agent, or Firm* — Sanchelima & Associates, P.A.; Christian Sanchelima; Jesus Sanchelima

(57) ABSTRACT

A two-cycle motor (10) has cylinder assembly (20) housing piston assembly (30) therein that moves reciprocally between two extreme positions controlled by a crankshaft. Cylinder assembly (20) includes combustion chamber (25) and an air compression chamber (45) in an enlarged annular portion (40). Portion (40) receives flange (31) integrally and radially outwardly extending from piston assembly (30) to define to air compression sub-chambers (47;47*a*). One-way inlet valve assemblies (41, 42) alternate to allow air in while outlet one-way valve assemblies (41*a*-42*a*) supply the compressed air to tank assembly (80) for release of the compressed air through intake one way valve assembly (29) to combustion chamber (25).

5 Claims, 3 Drawing Sheets

TWO-CYCLE MOTOR

BACKGROUND OF THE INVENTION

1. Field of the Invention

The present invention relates to two-cycle motors and, more particularly, to a two-cycle motor that includes secondary chambers to allow the air to be continuously compressed, stored and used in the combustion chamber.

2. Description of the Related Art

Several designs for two-cycle motors have been designed in the past. None of them, however, include a cylinder with an enlarged portion, hosing two compression chambers, where a flange coupled to the piston head continuously generate compressed air. The compressed air is stored and delivered to the combustion chamber. Inlet and outlet one-way valves connected to the compression chambers are actuated based on the movement of the piston assembly dispensing with the need to use other timing mechanisms. Also, an exhaust chamber mounted around a cylinder allows the burned gas to efficiently escape upon reaching maximum compression in the air compression chambers.

Applicant believes that a related reference corresponds to U.S. Pat. No. 2,455,245A issued for an expansible chamber motor with a valve flexible piston. Applicant believes that another related reference corresponds to U.S. Pat. No. 2,916,025A issued for a bounce chamber control mechanism for a free piston engine. None of these references, however, teach alternating and continuously operating secondary air compression chambers coupled to the piston assembly as described above.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the invention to provide a two-cycle motor that generates a continuous source of compressed air to the combustion chamber using the reciprocating movement of the piston assembly.

It is another object of this invention to provide a two-cycle motor that includes a tank for continuously receiving compressed air and making it available to the combustion chamber, as needed.

It is still another object of the present invention to provide a two-cycle motor that provides a cylinder with a plurality of through openings that allow the ignited gas to escape when the piston assembly travels a predetermined distance within the cylinder.

It is yet another object of the present invention to provide a two-cycle motor that eliminates 30% of loss of fresh load through the exhaust pipe.

It is still another object of the present invention to provide a two-cycle motor with a higher pressure inside the chamber to perform more efficiently.

It is yet another object of the present invention to provide a two-cycle motor that works like a four-stroke engine in the sense that oil and gas do not need to be mixed, thereby saving oil.

It is yet another object of this invention to provide such a motor that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
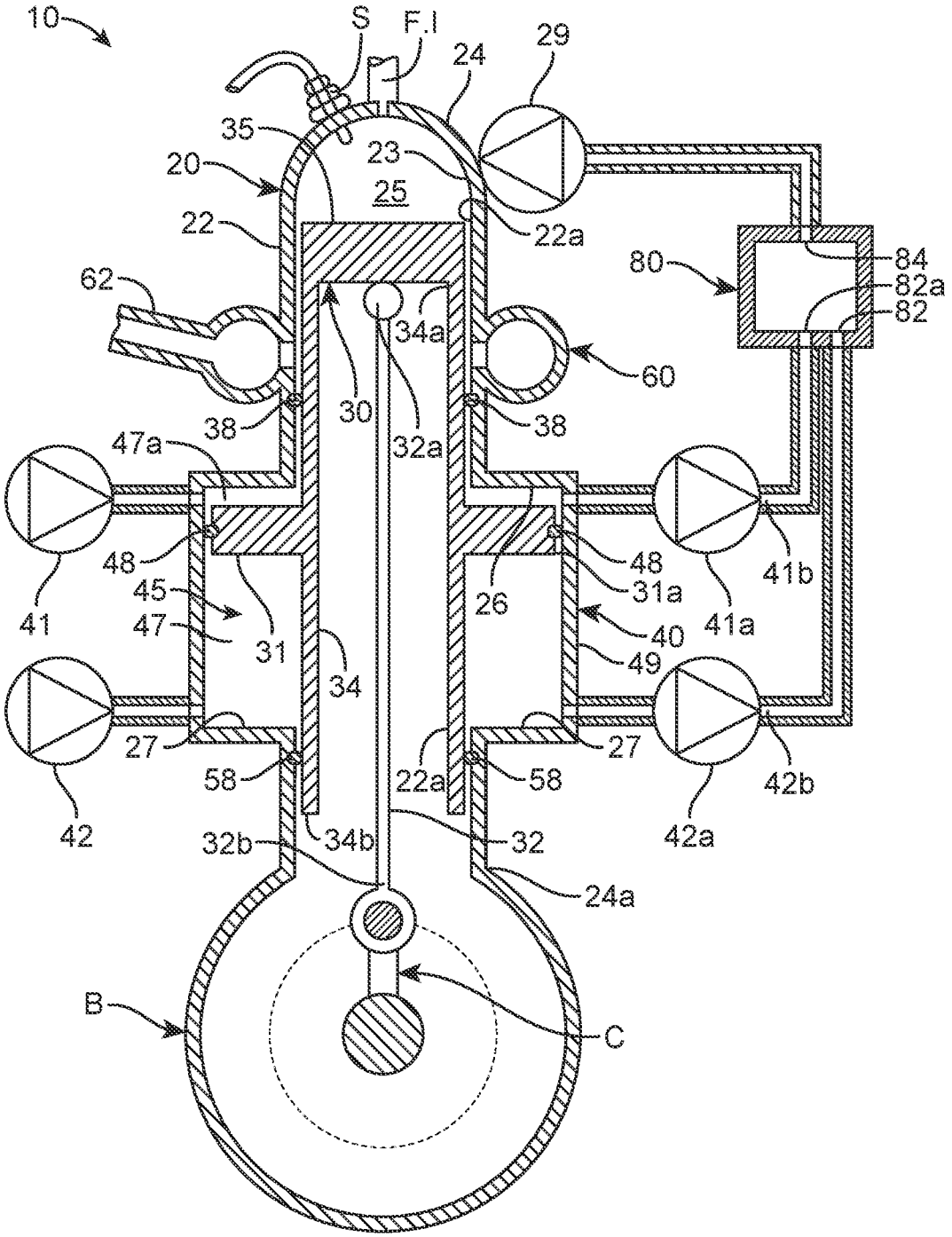
FIG. 1 represents a side cross sectional view (except for the piston rod) of one of the preferred embodiments for the present invention showing piston assembly 30 slidably housed within the cylinder assembly 20 in one (uppermost) extreme position.

Referring now to the drawings, where the present invention is generally referred to with numeral 10, it can be observed that it basically includes cylinder assembly 20, piston assembly 30, exhaust chamber assembly 60, tank assembly 80 and one-way valves 21; 29; 41; 41*a*. 42 and 42*a*. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 1A:
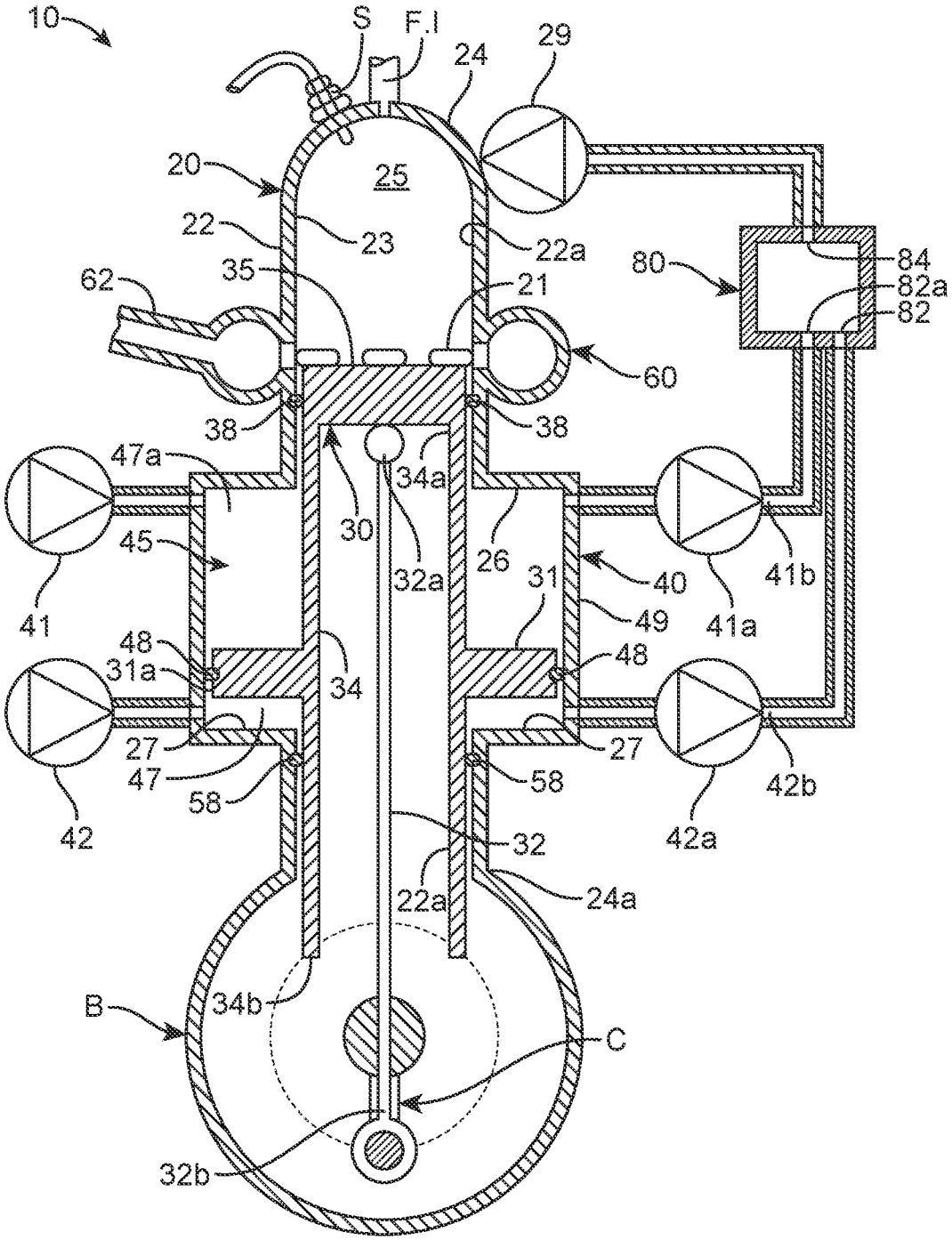
FIG. 1A represents a side cross sectional view (except for the piston rod 32) of one of the preferred embodiments for the present invention showing piston assembly 30 slidably housed within the cylinder assembly 20 in the other extreme position.
Figure 2:
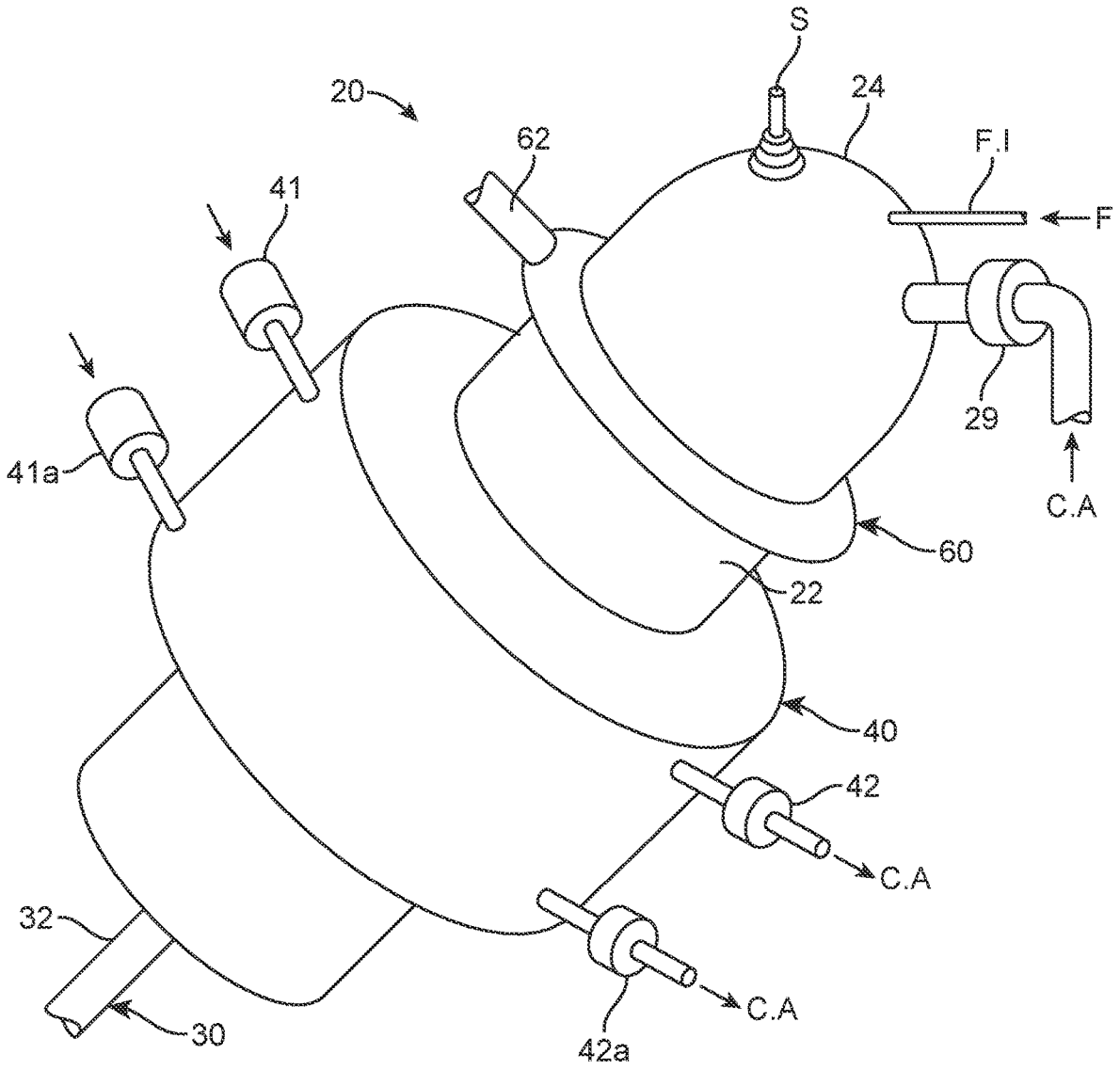
FIG. 2 shows an inclined isometric view of an embodiment for the present invention showing the exterior of the motor 10.

As shown in FIG. 1 and FIG. 1A, cylinder assembly 20 includes cylinder body 22, end 24, end 24*a* and radially expanded annular portion 40 between them. Inner surface 23, piston head 35 and end 24 define combustion chamber 25. Cylinder body 22 extends from end 24 a first predetermined distance before reaching enlarged annular portion 40. End 24 is closed preferably having a substantially concave shape defining combustion chamber 25. End 24*a* is open and connected to conventional engine block B. Cylinder assembly 20 further includes through openings 21 located at predetermined distance from end 24 and above annular portion 40. Spark plug S may be located at end 24. Spark plug S conventionally provides an electric energy to combustion chamber 25 fuel enriched compressed air. Fuel injection assembly FI enriches the compressed air in a conventional manner. Annular portion 40 extends from the abovementioned predetermined distance of the cylinder body 22 to a certain distance. Annular portion 40 has an enlarged cylindrical space defining air compression chamber 45 within the cylindrical assembly 20. Annular step bottom wall 27 and annular step top wall 26 extend inwardly from outer wall 49. Air compression sub-chambers 47 and 47*a* are defined below and above flange 31 inside air compression chamber 45.

Piston assembly 30 includes flange 31, connecting rod 32 and piston head 35. Piston head 35 may have a substantially cylindrical shape, in one of the preferred embodiments. Piston head 35 has piston skirt 34 with end 34*a* and end 34*b*. Piston skirt 34 extends away from end 34*a* to end 34*b*. End 34*a* of piston skirt 34 is integrally connected to the underside of piston head 35. Piston rod 32 is hingedly mounted to the underside of piston head 35 conventionally.

Piston skirt 34 includes an outwardly extending flange member 31. Piston head 35 has cooperative dimensions to be snugly and slidably received within cylinder body 22. Piston head 35 and piston skirt 34 are movable between two extreme positions. Piston head 35 is connected to piston connecting rod 32. Piston connecting rod 32 may be an elongated cylindrical rod in one of the preferred embodiments. Piston connecting rod 32 has end 32*a* and end 32*b*. End 32*b* of connecting rod 32 may be pivotally connected to crankshaft assembly C limiting movement of piston head 35 to two extreme positions.

Piston assembly 30 also includes piston sealing rings 38. The piston sealing ring 38 is embedded to interior wall 22*a* of cylinder body 22. Sealing ring 38 is located at a distance below piston through openings 21. Piston sealing ring 38 prevents the ignited air from leaving the combustion chamber when piston head 35 is above through openings 21. Sealing ring 38 insulates combustion chamber 25 from chamber 47*a*.

Sealing ring 48 is embedded in the outer wall 31*a* of flange 31 and cooperatively allow piston assembly 30 to snuggly slide with respect to annular portion 40. Sealing ring 48 insulates upper sub-chamber 47*a* from lower sub-chamber 47.

One-way inlet valve 41 is connected to upper sub-chamber 47*a* of annular portion 40. One-way inlet valve 42 is connected to lower sub-chamber 47 of annular portion 40. One-way inlet valve 41 and one-way inlet valve 42 alternate to allow air to flow in when the piston head 35 moves in one direction towards one of the two extreme positions. When air flows into chamber 47*a*, as flange 31 moves down, the air inside sub-chamber 47 is compressed and forced out through one-way valve 42*a*. The pressure inside sub-chamber 47 needs to surpass a predetermined pressure threshold in valve 42*a*. When flange 31 moves up, the air inside sub-chamber 47*a* is compressed and forced out through one-way valve 41*a*.

One-way outlet valve 41*a* is connected to upper sub-chamber 47*a* of annular portion 40. One-way outlet valve 42*a* is connected to lower sub-chamber 47 of annular portion 40. One-way outlet valve 41*a* and one-way outlet valve 42*a* alternate to allow compressed air to flow outwardly to tank assembly 80 when piston head 35 moves between the two extreme positions. When flange 31 moves down, the air inside sub-chamber 47 is compressed and forced out through one-way valve 42*a*.

The reciprocal movement of flange 31 is limited by the connection of connecting rod 32 to crankshaft C in a conventional way. In a preferred embodiment flange 31 does not come in contact with annular step top wall 26 or annular step bottom wall 27 of annular portion 40.

Tank assembly 80 stores compressed air. Tank inlets 82 and 82*a* are connected to outlet port 41*b* of one-way outlet valve 41*a* and to outlet port 42*b* of one-way valve 42*a*. Tank outlet 84 is connected to one-way valve 29. One-way valve 29 is connected through end 24 to combustion chamber 25 to supply compressed air. Tank assembly 80 may further include tank one-way outlet valve. Tank one-way outlet valve is released when the pressure is increased.

Exhaust chamber assembly 60 is located, in one of the preferred embodiments, around the perimeter of cylinder body 22 at a distance from the end 24 of the cylinder body 22 coinciding with through openings 21. Exhaust chamber assembly 60 may further include an exhaust pipe 62. Exhaust pipe 62 may have a substantially cylindrical shape. Exhaust pipe 62 extends outwardly from one side of the exhaust chamber assembly 60. Exhaust pipe 62 is in fluid communication with the exhaust chamber assembly 60. Exhaust chamber assembly 60 is in fluid communication with the interior of the cylinder body 22 through the through openings 21. The ignited air passes to exhaust chamber assembly 60 when piston assembly 30 moves down. Ignited air efficiently leaves the combustion chamber 25 through the through openings 21. The ignited air exiting the exhaust chamber assembly 60 allows motor 10 to be more efficiently, powerful and increase speed over conventional two-cycle motors.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A two-cycle motor, comprising: a cylinder assembly having first and second ends, said first end being closed and said second end being opened, said cylinder assembly including a cylinder body that extends a first predetermined distance from said first end, said cylinder body further including a plurality of through openings at a second predetermined distance from said first end, said cylinder body including a radially enlarged annular portion extending from said cylinder body at said first predetermined distance to a third predetermined distance thereby defining an air compression chamber within said cylindrical assembly and said second end being connected to an engine block B including a crankshaft assembly C therein; a piston assembly having a substantially cylindrical shape with third and fourth ends, said third end being closed defining a piston head and said fourth end being open with a piston skirt extending between said piston head and said fourth end, and further having an outwardly extending cylindrical flange member at a fourth predetermined distance from said third end, and said flange member having dimensions to be snugly yet slidably receivable within said air compression air chamber thereby defining air compression lower and upper sub-chambers, said piston head having dimensions to be snugly yet slidably receivable within said cylinder body and with said closed end defining a combustion chamber and, said piston head being reciprocally movable between an uppermost piston position and a bottommost piston position and further including a piston connecting rod having fifth and sixth ends, said fifth end being internally and pivotally connected to interior said third end and said sixth end being connected to said crankshaft thereby limiting the travel of said piston head to said uppermost piston position and bottommost piston position; first and second one-way inlet valve assemblies connected to said air compression lower and upper sub-chambers, respectively, to alternate in the generation of compressed air as said piston head moves between said uppermost piston position and bottommost piston position; first and second one-way outlet valve assemblies connected to said air compression lower and upper sub-chambers to alternate in generating compressed air as said piston head moves between said uppermost piston position and bottom-most piston position opposite to those allowing air in said air compression lower and upper sub-chambers, respectively; a tank assembly connected to said first and second one-way outlet valve assemblies receiving said compressed air above a predetermined pressure threshold; an intake one-way valve assembly connected to said tank assembly and to said combustion chamber to supply compressed air.

2. The two-cycle motor set forth in claim 1 further including an exhaust chamber assembly (60), wherein said exhaust chamber assembly (60) is located around the perimeter of said cylinder body (22) at the second distance from the first end (24) of the cylinder body (22).

3. The two-cycle motor set forth in claim 2, wherein said exhaust chamber assembly (60) includes an exhaust pipe (62), wherein said exhaust pipe (62) is connected and extends outwardly from the exhaust chamber (62).

4. The two-cycle motor set forth in claim 3 wherein said flange member does not come in contact with said cylinder body between said uppermost piston position and bottom-most piston position.

5. The two-cycle motor set forth in claim 1, wherein said air compression lower and upper sub-chambers (47; 47*a*) are sealed from the oil in the system, so that oil does not get into said air compression lower and upper sub-chambers (47; 47*a*).

* * * * *